US008177570B2

(12) United States Patent
Tanaka et al.

(10) Patent No.: US 8,177,570 B2
(45) **Date of Patent: *May 15, 2012**

(54) CABLE CONNECTOR

(75) Inventors: Hirohisa Tanaka, Tsu (JP); Shunsuke Hashimoto, Tsu (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/693,963

(22) Filed: Jan. 26, 2010

(65) Prior Publication Data

US 2010/0197158 A1 Aug. 5, 2010

Related U.S. Application Data

(63) Continuation of application No. 12/052,062, filed on Mar. 20, 2008, now Pat. No. 7,695,299.

(30) Foreign Application Priority Data

Mar. 27, 2007 (JP) ..... 2007-081569

(51) Int. Cl.
*H01R 13/15* (2006.01)

(52) U.S. Cl. ..... 439/259; 439/495

(58) Field of Classification Search ..... 439/259, 439/260, 261, 138, 495

See application file for complete search history.

(56) References Cited

U.S. PATENT DOCUMENTS 5,842,883 A 12/1998 Igarashi et al.
6,116,947 A 9/2000 Takayasu
6,383,017 B1 5/2002 Takayasu
6,755,682 B2 6/2004 Kunishi et al.
6,893,288 B2 5/2005 Tsunematsu
7,052,300 B2 5/2006 Okita et al.
7,077,691 B2 7/2006 Yokoo et al.
7,086,884 B2 * 8/2006 Okano ..... 439/260
7,270,567 B2 * 9/2007 Inoue ..... 439/495
7,275,948 B2 10/2007 Miura et al.
7,553,183 B2 6/2009 Taketomi et al.

(Continued)

FOREIGN PATENT DOCUMENTS

EP 1244179 9/2002

(Continued)

OTHER PUBLICATIONS

Taiwan Office action, dated Jul. 6, 2011 along with an english translation thereof.

*Primary Examiner* — Tulsidas C Patel
*Assistant Examiner* — Travis Chambers
(74) *Attorney, Agent, or Firm* — Greenblum & Bernstein, P.L.C.

(57) ABSTRACT

A cable connector includes a housing and a first contact provided in the housing. The first contact includes a first engaging and pivoting unit opposed to a back surface of the cable. The cable connector also includes a second contact which is provided in the housing and which includes a second engaging and pivoting unit opposed to the back surface of the cable. The second engaging and pivoting unit has a root which is thicker than that of the first engaging and pivoting unit. The cable connector also includes a cover. The cover includes a first through hole into which the first engaging and pivoting unit is inserted, a first cam unit engaged with the first engaging and pivoting unit, a second through hole into which the second engaging and pivoting unit is inserted, and a second cam unit engaged with the second engaging and pivoting unit.

8 Claims, 4 Drawing Sheets

U.S. PATENT DOCUMENTS

| | | | | |
|---|---|---|---|---|
| 7,695,299 | B2 * | 4/2010 | Tanaka et al. | 439/259 |
| 2005/0208824 | A1 | 9/2005 | Kayama et al. | |
| 2006/0141837 | A1 | 6/2006 | Okano | |
| 2006/0189190 | A1 | 8/2006 | Kato | |
| 2006/0258227 | A1 | 11/2006 | Ookura | |
| 2007/0049119 | A1 | 3/2007 | Fujimoto et al. | |
| 2007/0066127 | A1 | 3/2007 | Inoue | |
| 2007/0105408 | A1 | 5/2007 | Ookura | |
| 2007/0161274 | A1 | 7/2007 | Tanaka et al. | |
| 2008/0293282 | A1 | 11/2008 | Taketomi et al. | |

FOREIGN PATENT DOCUMENTS

| | | | |
|---|---|---|---|
| JP | 2001-110483 | | 4/2001 |
| JP | 2004-087361 | A | 3/2004 |
| JP | 2004-178931 | A | 6/2004 |
| JP | 2005-116495 | A | 4/2005 |
| JP | 2005-251764 | A | 9/2005 |
| JP | 2006-024373 | A | 1/2006 |
| JP | 2006-338955 | | 12/2006 |
| JP | 2006-338955 | A | 12/2006 |
| KR | 2007-23823 | | 2/2007 |
| TW | 543947 | | 7/2003 |
| WO | 2006/031279 | | 3/2006 |

* cited by examiner

CABLE CONNECTOR

CROSS-REFERENCE TO RELATED APPLICATION

This application is a Continuation of U.S. patent application Ser. No. 12/052,062, filed on Mar. 20, 2008,now U.S. Pat. No. 7,695,299 which claims the priority of Japanese Patent Application No. 2007-081569, filed Mar. 27, 2007, the disclosures of which is expressly incorporated by reference herein in its entirety.

BACKGROUND OF THE INVENTION

The present invention relates to a cable connector, and more particularly, to a cable connector suitable for connecting a cable such as a flat ribbon cable and FPC.

As a conventional cable connector, Japanese Patent Application Laid-open No. 2001-110483 (hereinafter, Patent Document 1) discloses a cable connector including a housing that receives an FPC cable, a plurality of first and second contacts fixed and held by the housing with a predetermined pitch, and an actuator that brings the FPC cable into contact with the first and second contacts under pressure.

According to the Patent Document 1, the first and second contacts are respectively integrally provided with first and second contact units which are opposed to one of surfaces of the FPC cable, and first and second engaging and pivoting units which are opposed to the opposite surface of the FPC cable. An outer periphery of the first engaging and pivoting unit is formed into an arc shape, and the arc first cam unit formed on the actuator and the arc first engaging and pivoting unit are engaged with each other. The actuator is formed with a through hole which is adjacent to the first cam unit such that the first engaging and pivoting unit runs around the first cam unit. With this configuration, the actuator is supported by the first engaging and pivoting unit such that the actuator can turn. The actuator is provided with an engaging cam groove, and the engaging cam groove and the second engaging and pivoting unit are engaged with each other.

SUMMARY OF THE INVENTION

According to the conventional technique, however, since the second engaging and pivoting unit of the second contact is in engagement with the engaging cam groove of the actuator, the opening operation of the actuator is restricted by the engagement between the engaging cam groove and the second engaging and pivoting unit at the time of opening operation of the actuator, and the opening angle of the actuator can not sufficiently be secured. Thus, the moving amount of the actuator is reduced when the cable is fixed, and there is a problem that the operability is deteriorated.

Therefore, an object of the present invention is to provide a cable connector in which the operability when a cable is fixed is enhanced.

To achieve the above object, the present invention provides a cable connector comprising a housing, a first contact which is provided in the housing and into which a sheet-like cable is inserted, and which includes a first contact unit opposed to a front surface of the cable and a first engaging and pivoting unit opposed to a back surface of the cable, a second contact which is provided in the housing in a side-by-side relation with the first contact, into which a cable is inserted, and which has a second contact unit opposed to the front surface of the cable and a second engaging and pivoting unit which is opposed to the back surface of the cable and which has a root thicker than that of the first engaging and pivoting unit, and a cover which includes a first through hole into which the first engaging and pivoting unit is inserted, a first cam unit engaged with the first engaging and pivoting unit, a second through hole into which the second engaging and pivoting unit is inserted and a second cam unit engaged with the second engaging and pivoting unit, which is turnably supported on the first engaging and pivoting unit by the first through hole and the first cam unit, which is turnably supported on the second engaging and pivoting unit by the second through hole and the second cam unit, and which brings the cable into contact with the contact units under pressure.

It is preferable to be configured that the first engaging and pivoting unit is engaged with the first cam unit so that the cover can move in an inserting and releasing direction of the cable, and the second engaging and pivoting unit limits movement of the cover in an inserting direction of the cable.

Further, it is preferable to be configured that the first contact is inserted into the housing along a separating direction of the cable, and the second contact is inserted into the housing along an inserting direction of the cable.

Further, it is preferable to be configured that a substantially arc projection which locks the cover in a state where the cover is opened is provided on a tip end of the second engaging and pivoting unit.

DETAILED DESCRIPTION OF THE PREFERRED EMBODIMENTS

Embodiments of the present invention will be explained below in detail with reference to the drawings.

Figure 1:
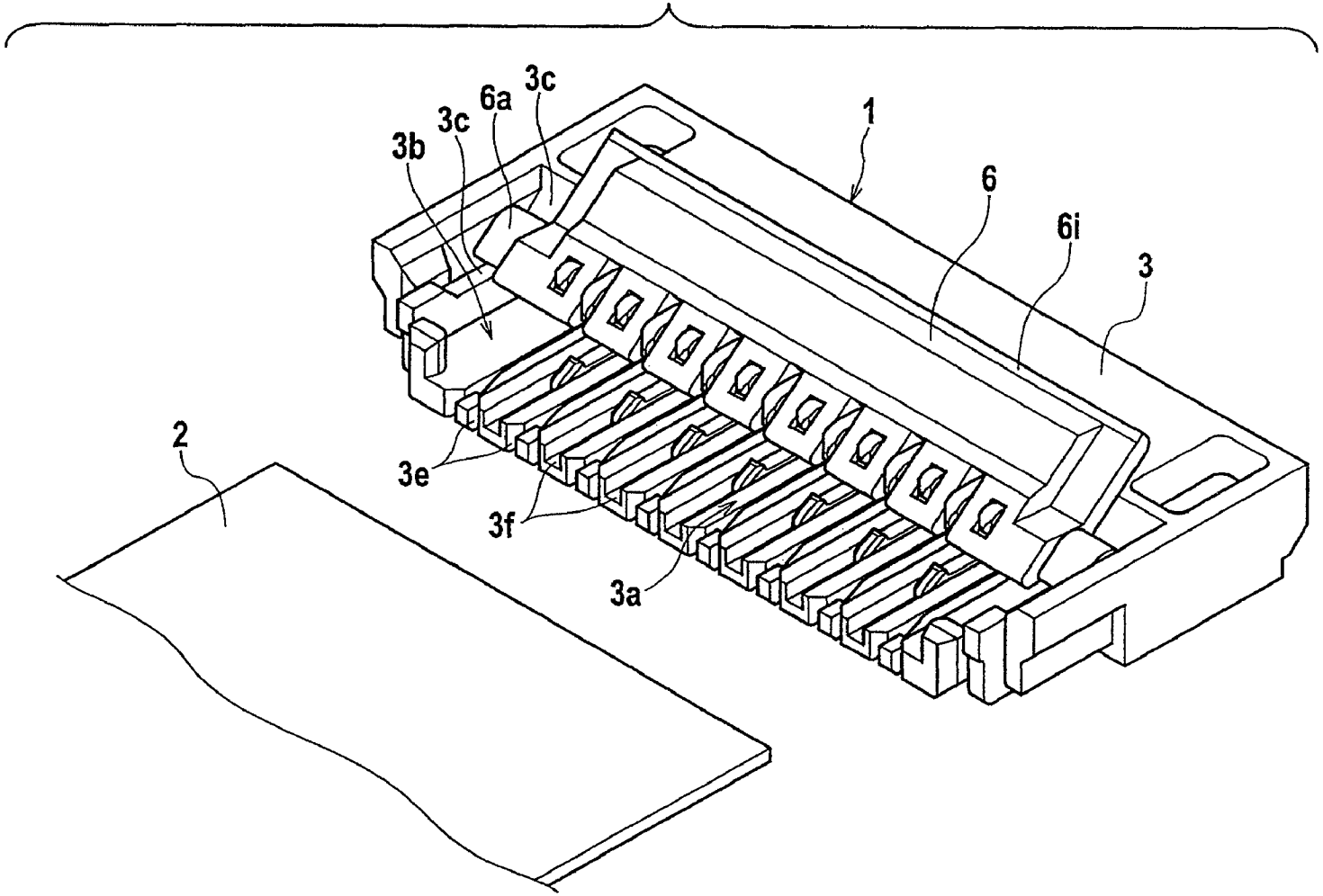
FIG. 1 is a perspective view of an external appearance of a cable connector according to an embodiment of the present invention.
Figure 2:
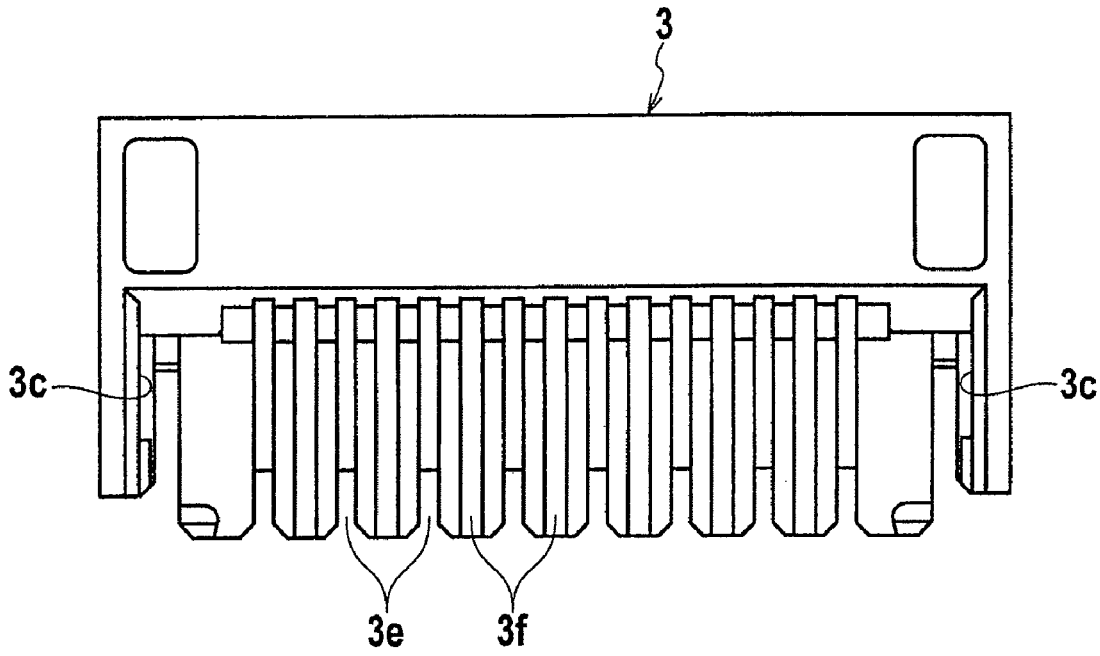
FIG. 2 is a plan view of a housing of the cable connector of the embodiment.
Figure 3:
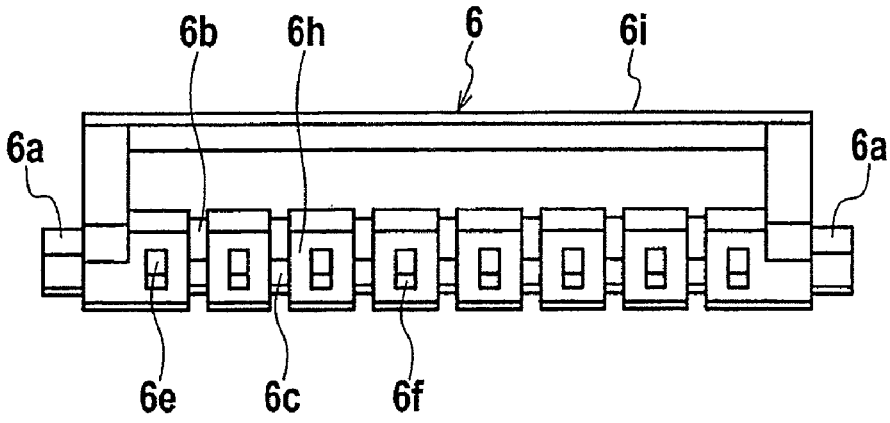
FIG. 3 is a front view of a cover of the cable connector of the embodiment.
Figure 4:
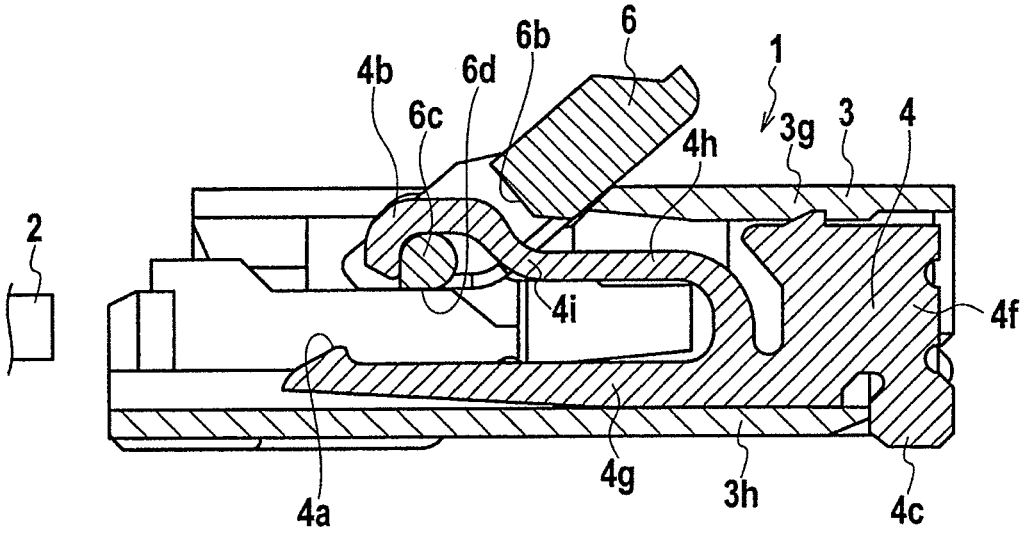
FIG. 4 is a sectional view of a first contact of the cable connector of the embodiment and shows a state where a cover is opened.
Figure 5:
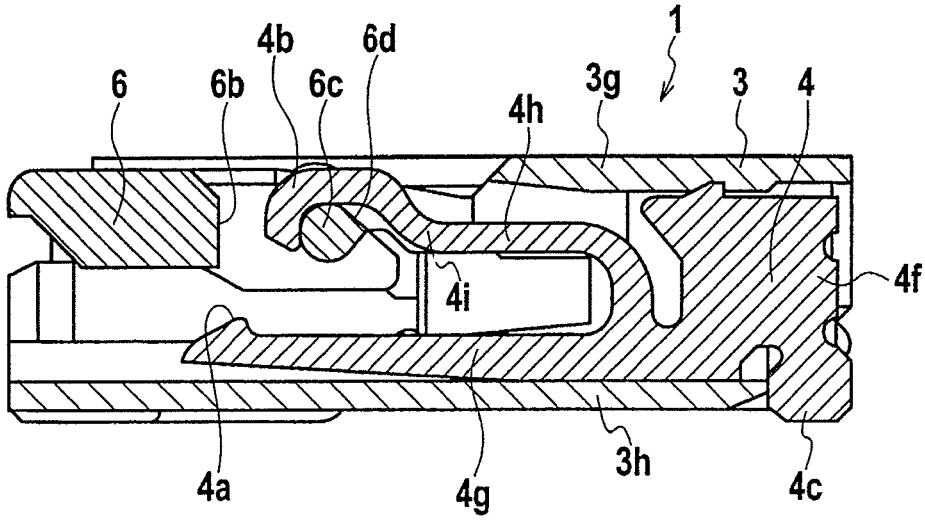
FIG. 5 is a sectional view of the first contact of the cable connector of the embodiment and shows a state where the cover is closed.
Figure 6:
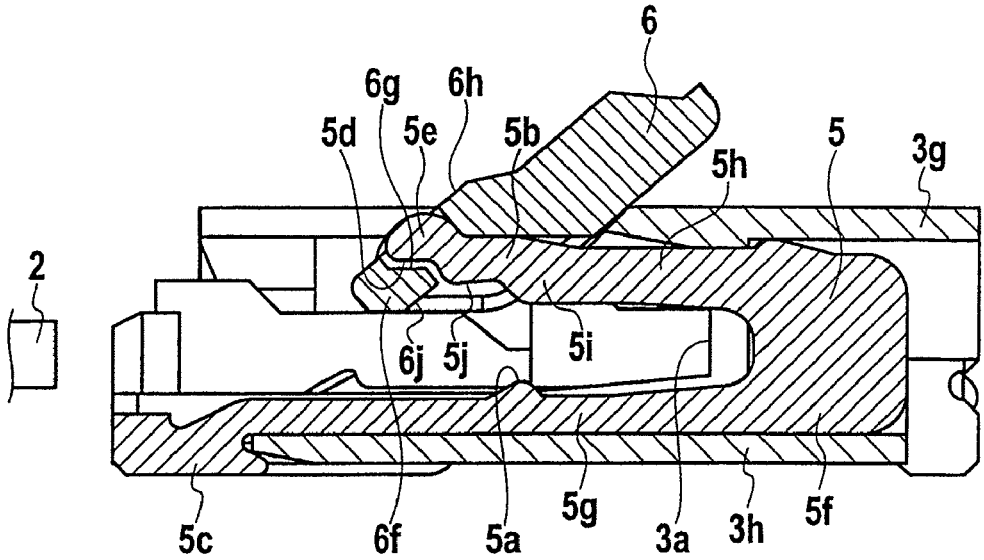
FIG. 6 is a sectional view of a second contact of the cable connector of the embodiment and shows a state where a cover is opened.
Figure 7:
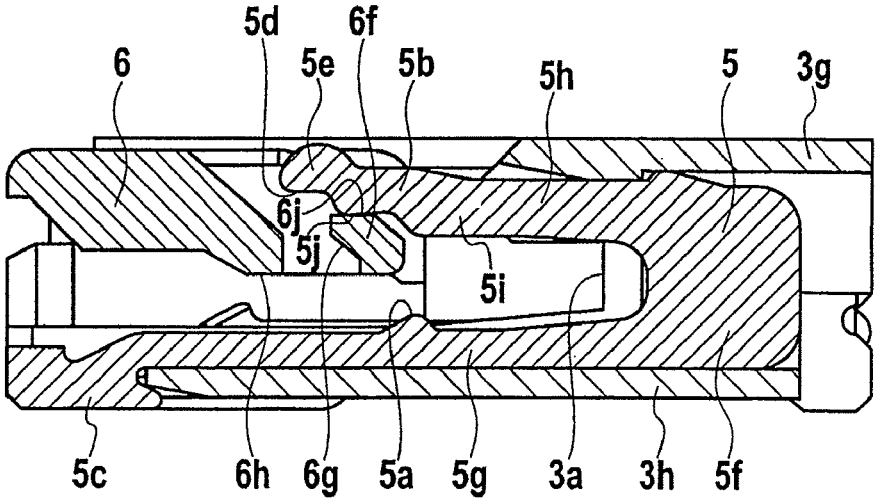
FIG. 7 is a sectional view of the second contact of the cable connector of the embodiment and shows a state where the cover is closed.

FIG. 1 is a perspective view of an external appearance of a cable connector according to an embodiment of the present invention, FIG. 2 is a plan view of a housing, FIG. 3 is a front view of a cover, FIG. 4 is a sectional view of a first contact and shows a state where a cover is opened, FIG. 5 is a sectional view of the first contact and shows a state where the cover is closed, FIG. 6 is a sectional view of a second contact and shows a state where the cover is opened, and FIG. 7 is a sectional view of the second contact and shows a state where the cover is closed.

A cable connector 1 includes an insulative housing 3 into which a sheet cable 2 such as FPC or FFC, having front surface and back surface. The cable connector 1 includes a plurality of insulative first contacts 4 which are arranged in one row at a predetermined pitch in the housing 3 and fixed and held therein. The first contact 4 includes a first contact unit 4*a* opposed to the front surface of the cable 2 and a first engaging and pivoting unit 4*b* opposed to the back surface of the cable 2. The cable connector 1 also includes a plurality of insulative second contacts 5 held in the housing 3 in parallel to the first contacts 4. The second contacts 5 include a second contact unit 5*a* opposed to the front surface of the cable 2 and a second engaging and pivoting unit 5*b* opposed to the back surface of the cable 2. The cable connector 1 also includes an insulative cover 6 which can turn between an open position where the cable 2 can be inserted into the housing 3 and a close position where the cable 2 inserted into the housing 3 can be pushed toward the first and second contact units 4*a* and 5*a*.

The housing 3 is made of insulative material such as synthetic resin. The housing 3 is formed at its vertically substantially intermediate portion with a bag-like cable receiving unit 3*a* into which the cable 2 is inserted from front (left side in FIG. 4).

A large number of conductors (not shown) are longitudinally exposed in two rows in a staggered form from a surface (lower surface in FIG. 4) of an insertion end of the cable 2.

A substantially half of an inlet side (front side) of an upper wall 3*g* of the housing 3 is removed, and an upper opening 3*b* for accommodating the cover 6 is formed at that portion.

Bearings 3*c* are formed at both ends of the upper opening 3*b* of the housing 3. Upper sides of the bearings 3*c* are opened. The bearings 3*c* are opposed to each other in the longitudinal direction of the housing 3.

The cover 6 is a plate-like member which can be accommodated in the upper opening 3*b* of the housing 3. The cover 6 is also made of insulative material such as synthetic resin. Pivot shafts 6*a* projects from base ends of left and right end surfaces of the cover 6. In the present embodiment, the left and right pivot shafts 6*a* of the cover 6 are placed on the left and right bearings 3*c* of the housing 3 from above the housing 3. With this configuration, the cover 6 is mounted on the upper opening 3*b* of the housing 3 such that the cover 6 can open and close (turn).

The cover 6 turns from an open position shown in FIGS. 4 and 6 to a close position shown in FIGS. 5 and 7. When the cover 6 is in the close position, the cover 6 assumes substantially horizontal attitude and is accommodated in the upper opening 3*b*, and the cover 6 pushes the cable 2 toward the contact units 4*a* and 5*a* (downward in FIG. 4). On the other hand, when the cover 6 is in the open position, the cover 6 rises from the upper opening 3*b* of the housing 3 in a backward inclined standing attitude, and a substantially half of the inlet side of the cable receiving unit 3*a* is opened above the housing 3 so that the cable 2 can be inserted into the cable receiving unit 3*a* of the housing 3. The cover 6 is provided with a knob 6*i* for opening the cover 6. In the present embodiment, the upper wall 3*g* of the housing 3 functions as a stopper which limits the turning motion of the cover 6 in the opening direction.

The first contacts 4 and the second contacts 5 are alternately arranged along the longitudinal direction of the housing 3. The first contacts 4 and the second contacts 5 are formed by punching a thin metal plate.

The first contacts 4 and the second contacts 5 are inserted into the housing 3 from two opposite directions. More specifically, the housing 3 is formed with a large number of first holes 3*f* into which the first contacts 4 are inserted one by one from back (deep side) to front (inlet side) of the housing 3, i.e., in the separating direction of the cable 2 (from right to left in FIG. 4), and with a large number of second holes 3*e* into which the second contacts 5 are inserted from front (inlet side) to back (deep side) of the housing 3, i.e., in the inserting direction of the cable 2 (from left to right in FIG. 6) one by one. The first contacts 4 and the second contacts 5 are alternately arranged in the housing 3 side-by-side in the longitudinal direction with the predetermined pitch through the first holes 3*f* and the second holes 3*e*. That is, the insertion amounts of the first contacts 4 and the second contacts 5 into the housing 3 can be adjusted.

The first contact 4 includes a base portion 4*f* which is fitted between upper and lower walls 3*g* and 3*h* at a deeper side than the cable receiving unit 3*a* of the housing 3, a lower arm unit 4*g* which extends from a lower end of the base portion 4*f* along the lower wall 3*h* of the housing 3 and which is arranged below the cable receiving unit 3*a*, and an upper arm unit 4*h* which extends to the upper opening 3*b* along the upper wall 3*g* of the housing 3 from the upper end of the base portion 4*f* and which is arranged above the cable receiving unit 3*a*.

The base portion 4*f* is provided at its upper edge with a projection. If the projection bites into the upper wall 3*g* of the housing 3 in the first hole 3*f*, the first contact 4 can be locked to the housing 3. A stopper 4*c* downwardly projects from a lower edge of the base 4*f*. The stopper 4*c* limits the maximum insertion amount of the first contact 4 into the housing 3 when the first contact 4 is inserted into the first hole 3*f* of the housing 3. The stopper 4*c* also serves as a surface mounting soldering unit projecting from a lower surface of the cable connector 1. As shown in FIG. 4, the stopper 4*c* downwardly projects from a tip end of the lower arm unit 4*g*.

The lower arm unit 4*g* is formed at its tip end with a first contact unit 4*a*. The lower arm unit 4*g* can elastically deform, and if the cable 2 is inserted, the lower arm unit 4*g* downwardly elastically deform so that an upper biasing force is applied.

A substantially hook-like first engaging and pivoting unit 4*b* is formed on a tip end of the upper arm unit 4*h* such that it can elastically deform in the vertical direction, and the engaging and pivoting unit 4*b* projects toward the upper opening 3*b*. In the present embodiment, the first engaging and pivoting unit 4*b* projects in the inserting direction of the cable 2 (right side in FIG. 4) than the position of the first contact unit 4*a*.

The second contact 5 includes a base portion 5*f* which is fitted in between the upper and lower walls 3*g* and 3*h* at a deeper side than the cable receiving unit 3*a* of the housing 3, a lower arm unit 5*g* which extends from a lower end of the base portion 5*f* to an inlet side front surface along the lower wall 3*h* of the housing 3 and which is arranged below the cable receiving unit 3*a*, and an upper arm unit 5*h* which extends from the upper end of the base portion 5*f* to the upper opening 3*b* along the upper wall 3*g* of the housing 3 and which is arranged above the cable receiving unit 3*a*.

The base portion 5*f* is provided at its upper edge with a projection. If the projection bites into the upper wall 3*g* of the housing 3 in the second hole 3*e*, the second contact 5 is locked to the housing 3.

The lower arm unit 5*g* is formed at its substantially intermediate portion with the second contact unit 5*a*, and the stopper 5*c* downwardly projects from a lower edge of a tip end of the lower arm unit 5*g*. The stopper 5*c* limits the maximum insertion amount of the second contact 5 into the housing 3 when the second contact 5 is inserted into the second hole 3*e* of the housing 3. The stopper 5*c* also serves as a surface mounting soldering unit projecting from a lower surface of the cable connector 1. As shown in FIG. 6, the stopper 5*c* downwardly projects from the tip end of the lower arm unit 5*g*.

The second engaging and pivoting unit 5*b* projects from a tip end of the upper arm unit 5*h* toward the upper opening 3*b*. The second engaging and pivoting unit 5*b* has a root 5*i* which is thicker than a root 4*i* of the first engaging and pivoting unit 4*b*. Since the root 5*i* is thick, the second engaging and pivoting unit 5*b* is less prone to be elastically deformed in the vertical direction as compared with the first engaging and pivoting unit 4*b*. In the present embodiment, as shown in FIGS. 6 and 7, a substantially arc projection 5*e* is provided on a tip end of the second engaging and pivoting unit 5*b* of the second contact 5, and the projection 5*e* locks the cover 6 in a state where the cover 6 is opened. A step-like engaging surface 5*d* is formed on a lower portion of the tip end of the second engaging and pivoting unit 5*b*, i.e., a lower portion of the projection 5*e*. A step-like abutting surface 5*j* is formed on a right side of the engaging surface 5*d* (in the inserting direction of the cable 2).

In the present embodiment, the first engaging and pivoting unit 4*b* and the second engaging and pivoting unit 5*b* project closer to the separating direction of the cable 2 (left side in FIGS. 4 and 6) than the position of the second contact unit 5*a*.

In a state where the first contacts 4 and the second contacts 5 are attached into the housing 3, the first contact units 4*a* of the first contacts 4 and the second contact units 5*a* of the second contacts 5 are arranged in the housing 3 in one row. As a result, the entire first and second contact units 4*a* and 5*a* are arranged in the staggered manner by the first contact units 4*a* of the first contacts 4 arranged in one row in the separating direction of the cable 2 and the second contact units 5*a* of the second contacts 5 arranged in one row in the inserting direction of the cable 2, and they can come into contact with the large number of conductors which are exposed in the staggered manner provided on the surface of the cable 2.

In the present embodiment, the first engaging and pivoting unit 4*b* and the second engaging and pivoting unit 5*b* are arranged in the housing 3 at a position above a location between the row of the first contact units 4*a* of the first contacts 4 and the row of the second contact units 5*a* of the second contacts 5.

The cover 6 is provided with a first through hole 6*b* in correspondence with the first engaging and pivoting unit 4*b* provided on the first contact 4. A first cam unit 6*c* which turns when the cover 6 turns is formed on the cover 6 at a location adjacent to the first through hole 6*b*. If the first engaging and pivoting unit 4*b* of the first contact 4 is engaged with the first cam unit 6*c*, the cover 6 is turnably supported by the first engaging and pivoting unit 4*b*. In the present embodiment, as shown in FIG. 4, the first engaging and pivoting unit 4*b* of the first contact 4 is engaged with the first cam unit 6*c* with play therebetween so that the first cam unit 6*c* can move in the inserting and releasing direction (inserting direction and releasing direction of the cable 2). Since the first engaging and pivoting unit 4*b* of the first contact 4 is engaged with the first cam unit 6*c* with play therebetween so that the first cam unit 6*c* can move in the inserting and releasing direction of the cable 2 in this manner, a friction force generated between the first engaging and pivoting unit 4*b* and the first cam unit 6*c* is reduced.

An outer surface of the cover 6 which is directed opposite side from the cable 2 when the cover 6 is in the close position is formed with an inclined surface 6*d* so that an end of the cover does not hinder the inserting motion of the cable 2 when the cover is opened. An inclined surface is also provided on the first cam unit 6*c* at a location corresponding to the inclined surface 6*d*, and the inclined surface 6*d* of the cover 6 and the inclined surface of the first cam unit 6*c* are flush with each other.

Cable pressing units 6*h* are formed on an inner surface of the cover 6 which is opposed to the cable 2 when the cover 6 is in the close position. The cable pressing unit 6*h* downwardly pushes the cable 2. The cable pressing unit 6*h* projects between the first through holes 6*b* in the inner surface of the cover 6.

Further, the cover 6 is provided with a second through hole 6*e* in correspondence with the second engaging and pivoting unit 5*b* provided on the second contact 5. As shown in FIG. 3, the second through hole 6*e* is formed such as to hollow out the cable pressing unit 6*h*. A second cam unit 6*f* which turns when the cover 6 turns is formed on the cover 6 at a location adjacent to the second through hole 6*e*. If the second engaging and pivoting unit 5*b* of the second contact 5 is engaged with the second cam unit 6*f*, the cover 6 is turnably supported by the second engaging and pivoting unit 5*b*.

In the present embodiment, an engaging cam surface 6*g* which is engaged with the engaging surface 5*d* when the cover 6 is opened is formed on the second cam unit 6*f*, and an abutting surface 6*j* which abuts against the abutting surface 5*j* when the cover 6 is closed is formed on the second cam unit 6*f*. As the cover 6 is opened or closed, the second cam unit 6*f* is turned from a position where the engaging cam surface 6*g* is engaged with the engaging surface 5*d* to a position where the abutting surface 6*j* abuts against the abutting surface 5*j*. The step-like abutting surface 5*j* provided on the second engaging and pivoting unit 5*b* limits the movement of the cover 6 in the inserting direction of the cable 2 and upward movement thereof.

According to the embodiment having the structure described above, if the cover 6 is opened, the cable 2 can easily be inserted into the cable receiving unit 3*a*.

If the cover 6 is turned to the closing position shown in FIGS. 5 and 7 after the cable 2 is inserted, the cable pressing unit 6*h* on the lower surface of the cover 6 presses the cable 2 toward the first contact unit 4*a* and the second contact unit 5*a*, the first contact unit 4*a*, the second contact unit 5*a* and the contact of the cable 2 are engaged with each other under appropriate pressure and they are electrically connected to each other. That is, the cable 2 is sandwiched between the first contact unit 4*a* and the second contact unit 5*a*, the lower arm unit 4*g* is elastically deformed downward by an amount corresponding to the thickness of the cable 2, and an appropriate contact pressure is obtained by the elastic force.

According to the present embodiment, the cover 6 is formed with the first through hole 6*b* and the first cam unit 6*c*, the first engaging and pivoting unit 4*b* is inserted into the first through hole 6*b* and is engaged with the first cam unit 6*c*, the cover 6 is formed with the second through hole 6*e* and the second cam unit 6*f*, the second engaging and pivoting unit 5*b* is inserted into the second through hole 6*e* and the second engaging and pivoting unit 5*b* is engaged with the second cam unit 6*f*. Therefore, the first engaging and pivoting unit 4*b* and the second engaging and pivoting unit 5*b* do not restrict the opening of the cover 6 at the time of opening operation of the cover 6, and the opening angle can be increased. As a result, the operability of the cover 6 when the cable 2 is fixed can be enhanced.

According to the present embodiment, the first engaging and pivoting unit 4*b* of the first contact 4 is engaged through the play so that the first cam unit 6*c* of the cover 6 can be moved in the inserting and releasing direction of the cable 2. Therefore, the first engaging and pivoting unit 4*b* does not limit the movement of the first cam unit 6*c* in the inserting and releasing direction (inserting direction and separating direction) of the cable 2, and it is possible to prevent a large friction force from being generated between the first engaging and pivoting unit 4*b* and the first cam unit 6*c* when the cover 6 is opened or closed, and the cover 6 can be opened and closed excellently.

According to the present embodiment, the second engaging and pivoting unit 5*b* of the second contact 5 limits the movement of the cover 6 in the inserting direction of the cable 2. Therefore, even if the first cam unit 6*c* of the cover 6 is engaged through the play so that the first cam unit 6*c* of the cover 6 can move in the inserting and releasing direction of the cable 2, since the movement of the cover 6 in the inserting and releasing direction of the cable 2 is suppressed, it is possible to suppress the saccadic movement when the cover 6 is opened or closed.

In the present embodiment, the turning center formed by engagement between the first cam unit 6*c* of the cover 6 and the first engaging and pivoting unit 4*b* of the first contact 4 is located above a position between the row of the first contact units 4*a* of the first contacts 4 and the row of the second contact units 5*a* of the second contacts 5. Therefore, the cover 6 can turn at a position where the cable 2 between the first contact unit 4*a* of the first contact 4 and the second contact unit 5*a* of the second contact 5 is prone to deform, and the cover 6 can be opened and closed more excellently.

Further, if the inserting amount of the first contact 4 and the second contact 5 into the housing 3 is appropriately set, there is a merit that the turning center of the cover 6 and the relative position between the first contact unit 4*a* and the second contact unit 5*a* are changed and a cable connector 1 having better operability can be obtained.

According to the present embodiment, the second engaging and pivoting unit 5*b* of the second contact 5 is provided with the step-like abutting surface 5*j*, and the cover 6 is provided with the abutting surface 6*j* which abuts against the abutting surface 5*j* when the cover 6 is closed. With this configuration, if the cover 6 is closed when the cable 2 is fixed, these abutting surfaces 5*j* and 6*j* limit the movement of the cover 6 in the inserting direction of the cable 2 and upward movement thereof. As a result, it is possible to prevent the closed cover 6 from opening when the cable is fixed, and the reliability of connection of the cable connector 1 can be enhanced. In the present embodiment, the second contact in which the thickness of the root 5*i* of the second engaging and pivoting unit 5*b* is thicker than the root 4*i* of the first engaging and pivoting unit 4*b* is used. With this configuration, the second engaging and pivoting unit 5*b* is less prone to elastically deform in the vertical direction, and it is possible to prevent the closed cover 6 from opening when the cable is fixed. As a result, the reliability of connection of the cable connector 1 can further be enhanced.

According to the present embodiment, the first contact 4 is inserted into the housing 3 along the separating direction of the cable 2, and the second contact 5 is inserted into the housing 3 along the inserting direction of the cable 2. With this configuration, the first contact 4 limits the movement of the cover 6 in the separating direction of the cable 2, and the second contact 5 can limits the movement of the cover 6 in the inserting direction of the cable 2. That is, since the first and second contacts 4 and 5 limit the movements of the cover 6 in the opposite directions, it is possible to prevent the cover 6 from rattling, and the cover 6 is not easily pulled out. In the present embodiment, the first contact 4 is inserted along the same direction as a direction in which the first engaging and pivoting unit 4*b* limits the movement of the cover 6 (separating direction of the cable 2), and the second contact 5 is inserted along the same direction as a direction in which the second engaging and pivoting unit 5*b* limits the movement of the cover 6 (inserting direction of the cable 2). Therefore, it is possible to make it more difficult to pull out the cover 6.

According to the present embodiment, the substantially arc projection 5*e* which locks the cover 6 in a state where the cover 6 is opened is provided on the tip end of the second engaging and pivoting unit 5*b*. Therefore, even if a force in the separating direction of the cable 2 is applied to the cover 6 when the cover 6 is opened, the substantially arc projection 5*e* locks the cover 6, it is possible to prevent the cover 6 from moving in the separating direction of the cable 2, and it is possible to make it difficult to break off the cover 6. Since the projection 5*e* is formed into the substantially arc shape, there is an advantage that the cover 6 can smoothly be operated along the projection 5*e* when the cover 6 is turned.

While the cable connector according to the exemplary embodiment of the present invention has been explained above, the present invention is not limited thereto and can also adopt various other embodiments without departing from the scope of the invention.

What is claimed is:

1. A cable connector, comprising:

a housing, a first contact which is provided in the housing and into which a sheet-like cable is inserted, and which includes a first contact unit opposed to a front surface of the cable and a substantially hook-shaped first engaging and pivoting unit opposed to a back surface of the cable, a second contact which is provided in the housing in a side-by-side relation with the first contact, into which a cable is inserted, and which has a second contact unit opposed to the front surface of the cable and a second engaging and pivoting unit which is opposed to the back surface of the cable and which has a root thicker than that of the first engaging and pivoting unit, and a cover which includes a first through hole into which the first engaging and pivoting unit is inserted, a first cam unit engaged with the first engaging and pivoting unit, a second through hole into which the second engaging and pivoting unit is inserted and a second cam unit engaged with the second engaging and pivoting unit, which is turnably supported on the first engaging and pivoting unit by the first through hole and the first cam unit, which is turnably supported on the second engaging and pivoting unit by the second through hole and the second cam unit, and which brings the cable into contact with the first and second contact units under pressure, wherein the first engaging and pivoting unit is engaged with the first cam unit with play therebetween so that the cover can move in an inserting and releasing direction of the cable, and the second engaging and pivoting unit limits movement of the cover in an inserting direction of the cable, wherein a surface of the second engaging and pivoting unit, which abuts the second cam unit, comprises a step, and wherein the step abuts the second cam unit when the cover is closed and disengages the second cam unit when the cover is opened.

2. The cable connector according to claim 1, wherein a substantially arc projection which locks the cover in a state where the cover is opened is provided on a tip.

3. The cable connector according to claim 1, wherein the first contact is inserted into the housing along a separating direction of the cable, and the second contact is inserted into the housing along an inserting direction of the cable.

4. The cable connector according to claim 3, wherein a substantially arc projection which locks the cover in a state where the cover is opened is provided on a tip end of the second engaging and pivoting unit.

5. A cable connector, comprising:

a housing, a first contact which is provided in the housing and into which a sheet-like cable is inserted, and which includes a first contact unit opposed to a front surface of the cable and a first engaging and pivoting unit opposed to a back surface of the cable, a second contact which is provided in the housing in a side-by-side relation with the first contact, into which a cable is inserted, and which has a second contact unit opposed to the front surface of the cable and a second engaging and pivoting unit which is opposed to the back surface of the cable and which has a root thicker than that of the first engaging and pivoting unit, and a cover which includes a first through hole into which the first engaging and pivoting unit is inserted, a first cam unit engaged with the first engaging and pivoting unit, a second through hole into which the second engaging and pivoting unit is inserted and a second cam unit engaged with the second engaging and pivoting unit, which is turnably supported on the first engaging and pivoting unit by the first through hole and the first cam unit, which is turnably supported on the second engaging and pivoting unit by the second through hole and the second cam unit, and which brings the cable into contact with the first and second contact units under pressure, wherein the first engaging and pivoting unit is engaged with the first cam unit so that the cover can move in an inserting and releasing direction of the cable, and the second engaging and pivoting unit limits movement of the cover in an inserting direction of the cable, the second engaging and pivoting unit comprises an engaging surface and an abutting surface, the engaging surface being positioned above and extending generally parallel to the abutting surface, an engaging cam surface of the second cam unit engages the engaging surface of the second engaging and pivoting unit when the cover is opened, and an abutting surface of the second cam unit abuts the abutting surface of the second engaging and pivoting unit when the cover is closed.

6. The cable connector according to claim 5, wherein a substantially arc projection which locks the cover in a state where the cover is opened is provided on a tip.

7. The cable connector according to claim 5, wherein the first contact is inserted into the housing along a separating direction of the cable, and the second contact is inserted into the housing along an inserting direction of the cable.

8. The cable connector according to claim 7, wherein a substantially arc projection which locks the cover in a state where the cover is opened is provided on a tip end of the second engaging and pivoting unit.

* * * * *